United States Patent [19]

Muraoka et al.

[11] Patent Number: 4,909,861

[45] Date of Patent: Mar. 20, 1990

[54] ALUMINUM ALLOY SHEET HAVING GOOD WELDABILITY, FILIFORM CORROSION RESISTANCE, FORMABILITY, AND BAKE-HARDENABILITY, AND A METHOD FOR MANUFACTURING THE SAME

[75] Inventors: Yasuo Muraoka, Wako; Mituo Hino; Yasunori Sasaki, both of Moka; Seiji Sasabe, Kanagawa, all of Japan

[73] Assignees: Kabushiki Kaisha Kobe Seiko Sho, Kobe; Honda Giken Kogyo Kabushiki Kaisha, Tokyo, both of Japan

[21] Appl. No.: 239,653

[22] Filed: Sep. 2, 1988

[30] Foreign Application Priority Data

Sep. 3, 1987 [JP] Japan ..... 62-220894

[51] Int. Cl.[4] ..... C22F 1/04

[52] U.S. Cl. ..... 148/12.7 A; 148/11.5 A; 148/415; 148/417; 148/439; 148/440

[58] Field of Search ..... 148/11.5 A, 12.7 A, 148/2, 439, 440, 415, 417

[56] References Cited

FOREIGN PATENT DOCUMENTS 62-89852 4/1987 Japan .
62-177143 8/1987 Japan .

*Primary Examiner*—R. Dean
*Attorney, Agent, or Firm*—Oblon, Spivak, McClelland, Maier & Neustadt

[57] ABSTRACT

An aluminum alloy sheet according to the present invention essentially consists of an aluminum alloy containing 0.5 to 1.4% magnesium, 0.6 to 1.5% silicon, and 0.005 to 0.1% titanium, all by weight, and aluminum and inevitable impurities for the remainder, and is adjusted so that the ratio of the silicon content to the magnesium content is 0.65 or more. The average crystal grain size and the electric conductivity of the aluminum alloy sheet are 70 μm or less and 43 to 51% IACS, respectively.

The composition of the aluminum alloy is adjusted in this manner, and the crystal grain size and the electric conductivity are restricted within the specific ranges by controlling the manufacturing conditions. Thus, there may be provided an aluminum alloy sheet which is improved in arc-weldability and resistance to filiform corrosion, as well as in formability and bake-hardenability at low temperature.

6 Claims, 1 Drawing Sheet

ALUMINUM ALLOY SHEET HAVING GOOD WELDABILITY, FILIFORM CORROSION RESISTANCE, FORMABILITY, AND BAKE-HARDENABILITY, AND A METHOD FOR MANUFACTURING THE SAME

BACKGROUND OF THE INVENTION

The present invention relates to an aluminum alloy sheet, which is improved in weldability, filiform corrosion resistance, bake-hardenability, and formability, and a method for manufacturing the same, and more particularly, to an aluminum alloy sheet, adapted for use as a material for the parts of land transportation vehicles, household electric appliances, various other machines, etc., which are formed by pressing or bending and used directly or after being assembled by welding, and a method for manufacturing the same.

Conventionally, aluminum alloy sheets, which are applicable to car components and other uses, are formed by pressing or bending. In some cases, they are subjected to paint baking (hereinafter referred to simply as baking), whereby they are heated after coating.

Presently, Al-Mg-Si alloys, such as 6009, 6010, 6111, and Al-Cu alloys, such as 2036, are practically used for aluminum alloy sheets which are adapted for forming and back hardening (process for improving the strength by baking). Although these alloys are poorer in formability than Al-Mg alloys, such as 5182, they are superior in bake-hardenability (susceptibility to baking). In particular, these specific alloys are characterized in that their strength can be improved by baking at a relatively high temperature of about 200° C. The above numbers of four figures are international registered designations for wrought aluminum and wrought aluminum alloys.

In consideration of the recently available baking temperature which tends to be as low as 175° C., the inventors hereof have proposed aluminum alloys adapted for this tendency, in Japanese Patent Applications Nos. 60-210768 and 61-18860.

For the application described above, weldability for assembly and corrosion resistance during use, as well as formability and bake-hardenability, are essential factors.

First, the weldability will be explained. In most cases, inner and outer panels are conventionally spot-welded together, in order to increase the rigidity of various parts of automobiles. Recently, however, aluminum alloy materials have started to be use not only for panel members but also for frame members. In other words, applicable regions for the aluminum alloy materials have increased. Thus, there have been increased places where the spot welding cannot be effected or cannot ensure satisfactory strength, or where fine cracks or the like, caused during the forming process, must be repaired. Recently, therefore, MIG or TIG arc welding have come to be frequently required in place of the spot welding.

Although the conventional alloys, such s the Al-Mg-Si alloys or the Al-Cu alloys, are poor in spotweldability, they have properties good enough to stand use. If subjected to arc welding, however, the Al-Cu alloys are liable to bead cracking, while heat-affected zones of the Al-Mg-Si alloys may sometimes suffer minor microcracks. Accordingly, the Al-Cu and Al-Mg-Si alloys are not suited for the application which requires arc welding.

The following is a description related to the corrosion resistance. Since anti-freezing mixtures, such a calcium chloride, may sometimes be sprinkled over roads, the corrosion resistance of car components is becoming a more important factor.

Aluminum alloys are superior to steel in corrosion resistance. If the paint comes off to expose the base material, however, filiform corrosion, a mode of corrosion different from normal corrosion, is caused at the boundary between the paint and the aluminum-alloy base material. The aforesaid Al-Cu and Al-Mg-Si alloys may also suffer filiform corrosion. To cope with this, therefore, the aluminum alloy sheet, as well as paints and the coating method (including a process for base treatment), has conventionally been improved. Heretofore, however, no satisfactory solution to the problem has been found yet.

SUMMARY OF THE INVENTION

The object of the present invention is to provide an aluminum alloy sheet, which is improved in arc-weldability and filiform corrosion resistance, as well as in formability and bake-hardenability, and a method for manufacturing the same.

An aluminum alloy sheet according to the present invention has the following composition (by weight):

Mg: 0.5 to 1.4%,
Si: 0.6 to 1.5%,
Ti: 0.005 to 0.1%,
Cu: less than 0.1%,
Mn: 0.1% or less,
Cr: 0.1% or less,
Zr: 0.05% or less,
V: 0.05% or less,
Fe: 0.3% or less, where there is a relation Si/Mg $\geqq$0.65, and the sum total of the Mn, Cr, Zr, V, and Fe contents is 0.4% or less by weight.

The remainder includes Al and other inevitable impurities. The aluminum alloy sheet has the average crystal grain size of 70 μm or less and electric conductivity of 43 to 51% IACS. The % IACS is a value compared with 100 for the conductivity of annealed pure copper.

A method for manufacturing an aluminum alloy sheet according to the present invention comprises a homogenizing process for heating an ingot of an aluminum alloy having the aforesaid composition to a temperature of 460° to 570° C. to homogenize the same; a hot rolling process for hot-rolling the homogenized ingot; a cold rolling process for cold-rolling the hot-rolled plate at a cold-rolling reduction of 30% or more; and a solution heat treatment for heating the cold-rolled sheet to a solution temperature of 490° to 560° C. at a heating rate of 200° C./min or more, keeping the sheet at the solution temperature for 5 to 80 seconds, and then cooling the sheet from the solution temperature to 100° C. at a cooling rate of 200° C./min or more.

By the solution heat treatment, the average crystal grain size and the electric conductivity of the sheet are adjusted to 70 μm or less and 43 to 51% IACS, respectively.

Further, the manufacturing method may comprise a heating process for heating the sheet to a temperature of 60° to 150° C. for 1 to 36 hours, within 72 hours after the end of the solution heat treatment.

Thus, according to the present invention, the average crystal grain size and the electric conductivity are restricted within a specific range by controlling the manufacturing conditions, a well as the chemical composition of the aluminum alloy. Accordingly, there may be provided an aluminum alloy sheet which is improved in weldability (especially arc-weldability) and filiform corrosion resistance, as well as in formability and bake-hardenability, especially at low temperature.

DETAILED DESCRIPTION OF THE PREFERRED EMBODIMENT

Figure 1:
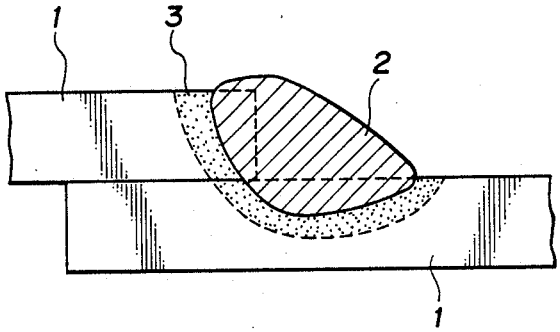
FIG. 1 is a sectional view of a welded portion for illustrating an evaluation test for microcracks.

The present invention will now be described further in detail.

First, the reasons for the addition of the components of an aluminum alloy sheet according to the present invention and for the limitation on the composition will be described.

Mg

Magnesium is an element which serves, in conjunction with Si, to improve the strength of the aluminum alloy sheet. If the Mg content is less than 0.5%, the strength (strength of the aluminum alloy sheet before and after baking at 175° C.; to be repeated hereinafter) is so low that the sheet is liable to microcracks. If the Mg content exceeds 1.4%, on the other hand, the formability is poor. Thus, in consideration of the balance between the strength, resistance of the welded portion to microcracks, and formability, the Mg content is adjusted within a range of 0.5 to 1.4%.

Si

Silicon is an element which serves, in conjunction with Mg, to improve the strength of the aluminum alloy sheet, and also singly to improve the resistance of the sheet to filiform corrosion. If the Si content is less than 0.6%, both the filiform corrosion resistance and the strength are poor. If the Si content exceeds 1.5% on the other hand, the sheet is liable to microcracks and is less formable, although its strength is improved. Thus, in consideration of the strength, weldability (microcrack resistance), filiform corrosion resistance, and formability, the Si content is adjusted within a range of 0.6 to 1.5%.

Although the Mgand Si contents are restricted within the above ranges, if the ratio of Si to Mg is less than 0.5, the filiform corrosion resistance, strength, and formability are poor. Accordingly, the Si-to-Mg ratio is adjusted to 0.65 or more.

Ti

Titanium is an element which serves to improve the formability of aluminum alloy sheet. To attain this effect, Ti should be added at 0.005% or more. If the Ti content exceeds 0.1%, however, large intermetallic compounds are produced, thereby lowering the formability. Thus, the Ti content is adjusted within a range of 0.005 to 0.1%. Although Ti is often added in the form of an Al-Ti master alloy, it may also be added in the form of an Al-Ti-B master alloy without failing to achieve the aforesaid purpose.

Cu

Copper serves to improve the strength of the aluminum alloy sheet. If the Cu content is 0.1% or more, however, the alloy sheet is liable to filiform corrosion and microcracks. When adding Cu, therefore, its content is adjusted to less than 0.1%.

Mn, Cr, Zr, V, and Fe

Manganese, chromium, zirconium, and vanadium serves to improve the strength of the aluminum alloy sheet. If their contents increase, however, large intermetallic compounds are produced, thereby lowering the formability. Although iron is less effective for the improvement of the strength, it also lowers the formability for the same reason. If the Mn, Cr, Zr, V, and Fe contents increase, moreover, filiform corrosion is liable to be caused.

Thus, if the aluminum alloy sheet contains Mn, Cr, Zr, V, o Fe, the Mn and Cr contents are each adjusted to 0.1% or less; Zr and V contents to 0.05% or less, and Fe content to 0.3% or less. At the same time, the su total of the Mn, Cr, Zr, V, and Fe contents is restricted to 0.4% or less.

Each of the Cu, Mn, Cr, Zr, V, and Fe contents may possibly be 0%.

Trace elements or inevitable impurities, such as Zn, Na, Ca, Be, etc., do no harm to the object of the present invention if their contents are 0.1% or less each. Thus, these elements are allowed to be contained up to 0.1%.

The following is a description of the crystal grain size and the electric conductivity of the aluminum alloy sheet.

The crystal grain size of the aluminum alloy sheet influences the formability, microcrack resistance, and filiform corrosion resistance. More specifically, if the average crystal grain size, as measured by the intercept method at the surface of the alloy sheet, exceeds 70 μm, the sheet is liable to microcracks and filiform corrosion, and also, its formability lowers. Accordingly, the average crystal grain size is restricted to 70 μm or less. The crystal grain size can be adjusted in accordance with the composition or the cold-rolling reduction (mentioned later), or by the solution heat treatment. Thus, the crystal grain size is settled after solution heat treating, and cannot be influenced by subsequent processes.

The electric conductivity influences all of the strength, formability, microcrack resistance, and filiform corrosion resistance. Since the microcrack resistance and the filiform corrosion resistance depend on the presence of the precipitates of $Mg_2Si$, they are greatly influenced by the electric conductivity.

As mentioned before, the filiform corrosion resistance is substantially influenced by the Cu content. Even in the case of an aluminum alloy having the Cu content of less than 0.1%, however, filiform corrosion is liable to be caused if the electric conductivity is less than 43% IACS.

Micro-cracking is also liable to be caused if Cu is contained, as mentioned before. Even in the case of an aluminum alloy having the Cu content of less than 0.1%, however, microcrack are easily caused if the electric conductivity exceeds 51% IACS.

Accordingly, the electric conductivity is adjusted within a range of 43 to 51% IACS. The electric conductivity is influenced by both the composition and the manufacturing method.

The following is a description of a method for manufacturing the aluminum alloy sheet described above.

First, an ingot of the aluminum alloy having the aforementioned composition is homogenized. If the heating temperature for this homogenizing process is lower than 460° C., the formability and the strength after a short time of baking at low temperature (e.g., at 175° C. for 30 minutes) are poor, and microcracks and filiform corrosion are liable to be caused. If the homogenizing temperature is higher than 570° C., on the other hand, the formability is extremely low, and the microcrack resistance is poor. Accordingly, the homogenizing temperature is adjusted within a range of 460° to 570° C. The homogenizing time must be long on the low-temperature side, while it may be short on the high-temperature size. Thus, the homogenizing time preferably ranges from 2 to 24 hours or thereabout, depending on the homogenizing temperature.

Subsequently, the homogenized ingot is hot-rolled. This hot rolling should preferably be performed at a temperature of about 200° to 580° C.

Then, the hot-rolled aluminum alloy plate is cold-rolled at a cold-rolling reduction of 30% or more. In this case, the plate may be subjected to annealing before the cold rolling, or to intermediate annealing after the start of the cold rolling. If the cold-rolling reduction is lower than 30%, microcracks are liable to be caused, and the formability is poor.

Thereafter, solution heat treating is performed. In this solution heat treatment, the aluminum alloy sheet is rapidly heated to and kept at high temperature for a short time, and is the rapidly cooled, in order to improve its strength and formability.

More specifically, the sheet should first be quickly heated to a high temperature of 490° to 560° C. at a heating rate of 200° C./min, and kept within this temperature range for 5 to 80 seconds. If the heating rate is lower than 200° C./min, the crystal grain size is so large that the elongation of the sheet is lowered. As a result, the formability is poor, and microcracks are liable to be caused. If the heating temperature is lower than 490° C., the strength lowers, and recrystallization cannot advance, so that the elongation is lowered. Accordingly, the formability is poor, and the electric conductivity is so high that microcracks are liable to be caused. If the heating temperature exceeds 560° C., the crystal grain size becomes so large tat microcracks are liable to be caused. Also, the stretchability (Erichsen value) and hence, the formability, are lowered. Furthermore, the electric conductivity is lowered, so that filiform corrosion is liable to be caused. Thus, in consideration of the strength, formability, microcrack resistance, and filiform corrosion resistance, the heating temperature is adjusted within a range of 490° to 560° C. For the same reason, the temperature hold time is restricted within the range of 5 to 80 seconds.

Subsequently, the aluminum alloy sheet is quickly cooled from the solution temperature to 100° C. at a cooling rate of 200° C./min or more. If the cooling rate is lower than 200° C./min, the strength is improved less after baking, and the formability is lowered. Further, the electric conductivity increases so that microcracks are liable to be caused.

After the solution heat treatment, a leveling process may be started immediately. Preferably, however, the following heat treatment is performed as required after the solution heat treating or leveling process. More specifically, the aluminum alloy sheet is heated to and kept at a temperature of 60° to 150° C. for 1 to 36 hours, within 72 hours (3 days) after the end of the solution heat treatment, without respect to the execution of the reforming process. Thereupon, the filiform corrosion resistance is improved, and also, the formability and the strength after a short time of baking at low temperature (e.g., at 175° C. for 30 minutes) are improved. After the lapse of 72 hours since the end of the solution heat treatment, however, no such effects can be produced despite the heating at the temperature of 60° to 150° C. Even when the sheet is heated within 72 hours, on the other hand, those effects are minor if the heating conditions deviate from the ranges of 60° to 150° C. and 1 to 36 hours.

The following is a description of the properties of an aluminum alloy according to an embodiment of the present invention, compared with those of an aluminum alloy according to a comparative example, and the differences between the properties of the aluminum alloys based on the difference of methods.

(EXAMPLE 1)

Aluminum Alloy Composition

Table 1 shows the respective compositions of the alloys according to the embodiment and the comparative example, and Table 2 shows the values of their properties. The aluminum alloys having the chemical compositions (% by weight) shown in Table 1 were dissolved and cast by an ordinary method. The resulting ingots were chamfered, and were then heated to a temperature of 520° C. at a heating rate of 50° C./hr (average heating rate for the temperature range between room temperature and 520° C.). This temperature was maintained for 6 hours for homogenization.

Subsequently, the ingots were hot-rolled to a thickness of 4 mm at a temperature of 250° to 520° C., and were then cold-rolled at room temperature at a rolling reduction of 75%. Thus, aluminum alloy sheets with a thickness of 1 mm were obtained.

Thereafter, the aluminum alloy sheets were subjected to solution heat treating. More specifically, they were heated at a heating rate of 400° C./min (average heating rate for the temperature range between room temperature and 530° C.), and were kept at 30° C. for 30 seconds. Then, the alloy sheets were cooled to 100° C. at a cooling rate of 800° C./min (average cooling rate for the temperature range of 530° to 100° C.).

After the solution heat treatment, the aluminum alloy sheets were left at room temperature for 24 hours, heated to and kept at 120° C. for 4 hours, and then left at room temperature for 30 days. Thereafter, they were checked for their mechanical properties, Erichsen value, electric conductivity, and crystal grain size, and were subjected to a microcrack test. Also, the alloy sheets were checked for their yield strength and filiform corrosion resistance after 30 minutes of baking at a temperature of 175° C. Table 2 shows the results of these tests.

The crystal grain size was obtained as the average value of 20 crystal grains by exposing the microstructure of the sheet surface by the intercept method.

The filiform corrosion test was conducted according to the following procedure.

Conditions for Test Piece Preparation:

Degreasing the aluminum alloy sheet; rinsing; zinc phosphate treatment; rinsing; drying; cationic electrodeposition (coating film of 20-μm thickness, 20 minutes of heating at 150° C.); second coating (coating film of 30 μm thickness, 25 minutes of heating at 140° C.); final coating (coating film of 35-μm thickness, 25 minutes of heating at 150° C.); and filiform corrosion test.

Conditions for Filiform Corrosion Test:

Artificially flawing the sheet by marking a crosshatch on the coating film by means of a knife; salt spraying (based on JIS-Z2371, 24-hour exposure); wetting (45° C. temperature, 95-% humidity, 20-day exposure); and evaluation of filiform corrosion resistance.

Criteria for Evaluation of Filiform Corrosion Resistance:

| (Length of filiform corrosion) | (Evaluation) |
|---|---|
| 1.0 mm or less: | Excellent |
| 1.1 to 2.0 mm: | Good |
| 2.1 to 4.0 mm: | Fair |
| 4.1 to 8.0 mm: | Poor |
| 8.1 mm or more: | Very poor |

The microcrack test was conducted as follows. First, two aluminum alloy sheets 1 were put one on top of the other, as shown in FIG. 1, and were subjected to fillet welding based on the TIG welding process (using filler metal 4043, current of 50 to 60 A, and welding speed of 20 cm/min). Then, intergranular microcracks (cracks with a length of about 50 to 100 μm) on the section of a heat-affected zone (HAZ) 3 were counted. Based on the number of these microcracks, the microcrack resistance was evaluated as follows.

| (Number of microcracks) | (Evaluation) |
|---|---|
| 0: | Excellent |
| 1 to 2: | Good |
| 3 to 5: | Fair |
| 6 to 8: | Poor |
| 9 or more: | Very poor |

As seen from Table 2, all of the materials of the examples are subject to no or minor microcracks, and are improved in formability and bake-hardenability, as well as in weldability and filiform corrosion resistance. In contrast with this, the materials of the comparative examples, which are different in composition from those restricted by the claims of the present invention, are poor in weldability, filiform corrosion resistance, and/or bake-hardenability, although they enjoy satisfactory crystal grain size or electric conductivity.

TABLE 1

| | Alloy No. | Mg | Si | Cu | Ti | Mn | Cr | Zr | V | Fe | Si/Mg | Mn + Cr + Zr + V + Fe |
|---|---|---|---|---|---|---|---|---|---|---|---|---|
| | 1 | 0.6 | 1.3 | 0.07 | 0.03 | 0.01 | 0.01 | 0.01 | 0.001 | 0.17 | 2.2 | 0.24 |
| | 2 | 0.6 | 0.8 | 0.07 | 0.03 | 0.01 | 0.01 | 0.01 | 0.001 | 0.17 | 1.3 | 0.24 |
| | 3 | 0.9 | 1.2 | 0.01 | 0.03 | 0.01 | 0.01 | 0.01 | 0.001 | 0.17 | 1.3 | 0.24 |
| Alloys | 4 | 0.9 | 1.0 | 0.01 | 0.03 | 0.01 | 0.01 | 0.01 | 0.001 | 0.17 | 1.1 | 0.24 |
| of | 5 | 0.9 | 0.7 | 0.01 | 0.03 | 0.01 | 0.01 | 0.01 | 0.001 | 0.17 | 0.8 | 0.24 |
| Examples | 6 | 1.2 | 1.2 | 0.07 | 0.03 | 0.01 | 0.01 | 0.01 | 0.001 | 0.17 | 1.0 | 0.24 |
| | 7 | 1.2 | 0.9 | 0.07 | 0.03 | 0.01 | 0.01 | 0.01 | 0.001 | 0.17 | 0.8 | 0.24 |
| | 8 | 0.9 | 1.0 | 0.01 | 0.08 | 0.01 | 0.01 | 0.01 | 0.001 | 0.17 | 1.1 | 0.24 |
| | 9 | 0.9 | 1.0 | 0.01 | 0.03 | 0.07 | 0.06 | 0.03 | 0.03 | 0.17 | 1.1 | 0.36 |
| | 10 | 0.3 | 0.5 | 0.3 | 0.03 | 0.01 | 0.01 | 0.01 | 0.001 | 0.17 | 1.7 | 0.20 |
| | 11 | 0.3 | 1.0 | 0.3 | 0.03 | 0.01 | 0.01 | 0.01 | 0.001 | 0.17 | 3.3 | 0.20 |
| | 12 | 0.3 | 1.6 | 0.3 | 0.03 | 0.01 | 0.01 | 0.01 | 0.001 | 0.17 | 5.3 | 0.20 |
| | 13 | 0.9 | 0.4 | 0.3 | 0.03 | 0.01 | 0.01 | 0.01 | 0.001 | 0.17 | 0.4 | 0.20 |
| | 14 | 0.9 | 1.6 | 0.3 | 0.03 | 0.01 | 0.01 | 0.01 | 0.001 | 0.17 | 1.8 | 0.20 |
| Alloys | 15 | 1.5 | 0.4 | 0.3 | 0.03 | 0.01 | 0.01 | 0.01 | 0.001 | 0.17 | 0.3 | 0.20 |
| of | 16 | 1.5 | 0.9 | 0.3 | 0.03 | 0.01 | 0.01 | 0.01 | 0.001 | 0.17 | 0.6 | 0.20 |
| Comparative | 17 | 1.5 | 1.6 | 0.3 | 0.03 | 0.01 | 0.01 | 0.01 | 0.001 | 0.17 | 1.1 | 0.20 |
| Examples | 18 | 0.9 | 1.0 | 0.6 | 0.03 | 0.01 | 0.01 | 0.01 | 0.001 | 0.17 | 1.1 | 0.20 |
| | 19 | 0.9 | 1.0 | 0.3 | 0.13 | 0.01 | 0.01 | 0.01 | 0.001 | 0.17 | 1.1 | 0.20 |
| | 20 | 0.9 | 1.0 | 0.3 | 0.03 | 0.20 | 0.12 | 0.00 | 0.00 | 0.17 | 1.1 | 0.49 |
| | 21 | 0.9 | 1.0 | 0.3 | 0.003 | 0.30 | 0.12 | 0.07 | 0.07 | 0.17 | 1.1 | 0.73 |
| | 22 | 0.9 | 1.0 | 0.3 | 0.03 | 0.30 | 0.12 | 0.07 | 0.07 | 0.25 | 1.1 | 0.81 |
| | 23 | 0.9 | 1.0 | 0.3 | 0.03 | 0.30 | 0.12 | 0.07 | 0.07 | 0.17 | 1.1 | 0.81 |

(% by weight)

TABLE 2

| | | Material Properties | | | | | | | Properties of Baking Material | |
|---|---|---|---|---|---|---|---|---|---|---|
| | Alloy No. | Tensile Strength (kg/mm²) | Yield Strength (kg/mm²) | Elongation (%) | Erichsen Value (mm) | Conductivity IACS (%) | Mean Grain Size (μm) | Microcrack Resistance | Post-baking Yield Strength (kg/mm²) | Filiform Corrosion Resistance |
| | 1 | 23 | 13 | 30 | 10.1 | 47 | 40 | Good | 15 | Good |
| | 2 | 21 | 12 | 32 | 10.1 | 49 | 45 | Good | 14 | Excellent |
| | 3 | 24 | 14 | 30 | 10.0 | 46 | 35 | Excellent | 16 | Excellent |
| Alloys | 4 | 23 | 13 | 33 | 10.3 | 47 | 35 | Excellent | 15 | Excellent |
| of | 5 | 22 | 12 | 30 | 10.3 | 49 | 45 | Excellent | 14 | Excellent |
| Examples | 6 | 23 | 13 | 28 | 9.8 | 45 | 30 | Excellent | 15 | Good |
| | 7 | 22 | 13 | 32 | 10.0 | 46 | 30 | Excellent | 15 | Good |
| | 8 | 23 | 13 | 29 | 10.0 | 45 | 35 | Excellent | 15 | Good |
| | 9 | 23 | 13 | 28 | 9.8 | 45 | 30 | Excellent | 15 | Good |
| | 10 | 15 | 7 | 30 | 10.3 | 51 | 50 | Fair | 8 | Fair |
| | 11 | 20 | 10 | 28 | 9.6 | 50 | 45 | Fair | 11 | Fair |
| | 12 | 21 | 11 | 26 | 9.4 | 50 | 40 | Poor | 13 | Fair |
| | 13 | 17 | 8 | 26 | 9.6 | 48 | 45 | Fair | 8 | Poor |
| | 14 | 23 | 14 | 24 | 9.4 | 47 | 35 | Poor | 16 | Fair |
| Alloys | 15 | 17 | 8 | 28 | 9.6 | 43 | 40 | Fair | 8 | Poor |
| of | 16 | 23 | 14 | 26 | 9.4 | 42 | 35 | Fair | 14 | Fair |
| Comparative | 17 | 24 | 14 | 24 | 9.3 | 42 | 30 | Poor | 15 | Fair |

TABLE 2-continued

| | Alloy No. | Material Properties: Tensile Strength (kg/mm²) | Yield Strength (kg/mm²) | Elongation (%) | Erichsen Value (mm) | Conductivity IACS (%) | Mean Grain Size (μm) | Microcrack Resistance | Properties of Baking Material: Post-baking Yield Strength (kg/mm²) | Filiform Corrosion Resistance |
|---|---|---|---|---|---|---|---|---|---|---|
| Examples | 18 | 28 | 16 | 24 | 9.3 | 46 | 35 | Very Poor | 18 | Very Poor |
| | 19 | 24 | 13 | 24 | 9.3 | 41 | 35 | Fair | 15 | Poor |
| | 20 | 24 | 13 | 24 | 9.2 | 45 | 30 | Fair | 15 | Fair |
| | 21 | 24 | 13 | 23 | 9.1 | 44 | 30 | Fair | 15 | Poor |
| | 22 | 24 | 13 | 23 | 8.6 | 43 | 25 | Fair | 15 | Poor |
| | 23 | 24 | 13 | 25 | 9.3 | 46 | 30 | Fair | 15 | Poor |

(EXAMPLE 2)

From Homogenization to Solution Heat Treatment

The following is a description of the relationships between the properties of the aluminum alloys and the treatment conditions for the processes from the homogenization process to the solution heat treatment.

Each of aluminum alloys Nos. 2, 4 and 6 according to the examples, shown in Table 1, was dissolved and cast by the ordinary method. The resulting ingot was chamfered, and was then heated at a heating rate of 40° C./hr. Subsequently, the ingot was homogenized at the various temperatures and for the various times shown in Table 3. Thereafter, it was hot-rolled to a thickness of 4 mm at a temperature of 250° to 90° C., and was then cold-rolled.

During the cold rolling, intermediate annealing (at 350° C. for 2 hours) was performed for some of the aluminum alloys, and the final cold-rolling reduction was changed variously as shown in Table 3. Thus, aluminum alloy sheets with a thickness of 1 mm were obtained.

Thereafter, these aluminum alloy sheets were subjected to solution heat treating under the condition shown in Table 3. More specifically, the alloy sheets were heated at a heating rate of 100° to 600° C./min, and were then quickly heated to a temperature of 470° to 570° C. After they were kept within this temperature range for 5 to 90 seconds, the alloy sheets were rapidly cooled to 100° C. at a cooling rate of 100° to 800° C./min.

Subsequently, the aluminum alloy sheets were left at room temperature for 24 hours, heated to and kept at 120° C. for 4 hours and then left at room temperature for 30 days. Thereafter, the various tests were conducted in the same manner as aforesaid. Table 4 shows the results of these tests.

Even in the case of an aluminum alloy sheet having its composition within the range provided by the present invention, as seen from Table 4, the bake-hardenability or the filiform corrosion resistance, as well as the weldability, is insufficient if any of the manufacturing conditions is deviated from the standard of the invention.

If the homogenizing condition is deviated from the ranges given by the present invention, as in the cases of comparative methods K and L, the elongation capability and the Erichsen value are lowered, and the formability is poor. Thus, the electric conductivity is also out of the range of the invention, so that the filiform corrosion resistance and the microcrack resistance are poor.

If the cold-rolling reduction is too low, as in the case of comparative method M, the crystal grains become so coarse that microcracks are very liable to be caused.

If the solution temperature is too low, as in the case of comparative method N, the strength, formability, and microcrack resistance are poor.

If the solution temperature is too high, as in the case of comparative method O, the crystal grain size is so large that the microcrack resistance is lowered.

If the cooling rate for quenching is too low, as in the case of comparative method P, the strength is very poor, and the electric conductivity is high. Thus, the microcrack resistance is lowered.

If the heating rate for solution is too low, as in the case of comparative method Q, the crystal grains become so coarse that the microcrack resistance is lowered.

TABLE 3

| | Production Symbol | Alloy No. | Homogenizing Condition (°C. × hr) | Intermediate Annealing | Cold-rolling Reduction (%) | Solution Quenching Conditions: Heating Rate (°C./min) | Heating Hold (°C. × min) | Cooling Rate (°C./min) |
|---|---|---|---|---|---|---|---|---|
| Method of Invention | A | 2 | 520 × 4 | Undone | 75 | 400 | 520 × 30 | 800 |
| | B | 4 | 470 × 12 | Undone | 75 | 400 | 520 × 30 | 800 |
| | C | 4 | 520 × 4 | Undone | 75 | 400 | 520 × 30 | 800 |
| | D | 4 | 550 × 4 | Undone | 75 | 400 | 520 × 30 | 800 |
| | E | 4 | 520 × 4 | Done | 40 | 400 | 520 × 30 | 800 |
| | F | 4 | 520 × 4 | Undone | 75 | 400 | 550 × 10 | 800 |
| | G | 4 | 520 × 4 | Undone | 75 | 400 | 500 × 40 | 800 |
| | H | 4 | 520 × 4 | Undone | 75 | 400 | 520 × 30 | 300 |
| | I | 6 | 520 × 4 | Undone | 75 | 400 | 520 × 30 | 800 |
| | J | 4 | 520 × 4 | Undone | 75 | 300 | 520 × 30 | 800 |
| | K | 4 | 450 × 12 | Undone | 75 | 400 | 520 × 30 | 800 |
| | L | 4 | 580 × 4 | Undone | 75 | 400 | 520 × 30 | 800 |
| Comparative Method | M | 4 | 520 × 4 | Done | 20 | 400 | 520 × 30 | 800 |
| | N | 4 | 520 × 4 | Undone | 75 | 400 | 470 × 90 | 800 |
| | O | 4 | 520 × 4 | Undone | 75 | 400 | 570 × 5 | 800 |
| | P | 4 | 520 × 4 | Undone | 75 | 400 | 520 × 30 | 100 |

TABLE 3-continued

| Production Symbol | Alloy No. | Homogenizing Condition (°C. × hr) | Intermediate Annealing | Cold-rolling Reduction (%) | Solution Quenching Conditions: Heating Rate (°C./min) | Heating Hold (°C. × min) | Cooling Rate (°C./min) |
|---|---|---|---|---|---|---|---|
| Q | 4 | 520 × 4 | Undone | 75 | 100 | 520 × 30 | 800 |

TABLE 4

| | Production Symbol | Alloy No. | Material Properties: Tensile Strength (kg/mm²) | Yield Strength (kg/mm²) | Elongation (%) | Erichsen Value (mm) | Conductivity IACS (%) | Mean Grain Size (μm) | Microcrack Resistance | Properties of Baking Material: Post-baking Yield Strength (kg/mm²) | Filiform Corrosion Resistance |
|---|---|---|---|---|---|---|---|---|---|---|---|
| Method of Invention | A | 2 | 21 | 12 | 33 | 10.1 | 49 | 44 | Good | 14 | Excellent |
| | B | 4 | 21 | 12 | 30 | 10.2 | 49 | 34 | Good | 13 | Excellent |
| | C | 4 | 23 | 13 | 33 | 10.3 | 46 | 36 | Excellent | 15 | Excellent |
| | D | 4 | 24 | 14 | 32 | 10.2 | 44 | 40 | Excellent | 16 | Excellent |
| | E | 4 | 23 | 13 | 30 | 9.9 | 46 | 60 | Good | 15 | Excellent |
| | F | 4 | 23 | 13 | 33 | 10.1 | 44 | 58 | Good | 15 | Excellent |
| | G | 4 | 23 | 12 | 30 | 10.3 | 48 | 30 | Good | 14 | Excellent |
| | H | 4 | 23 | 12 | 33 | 10.3 | 48 | 45 | Excellent | 14 | Excellent |
| | I | 6 | 23 | 13 | 28 | 9.8 | 45 | 30 | Excellent | 15 | Excellent |
| | J | 4 | 23 | 13 | 33 | 10.8 | 45 | 40 | Excellent | 15 | Excellent |
| Comparative Method | K | 4 | 20 | 11 | 28 | 9.8 | 52 | 35 | Fair | 12 | Good |
| | L | 4 | 24 | 14 | 27 | 9.7 | 42 | 60 | Fair | 16 | Good |
| | M | 4 | 23 | 13 | 27 | 9.6 | 46 | 80 | Poor | 15 | Good |
| | N | 4 | 20 | 10 | 28 | 9.8 | 54 | 30 | Fair | 10 | Excellent |
| | O | 4 | 23 | 13 | 28 | 9.6 | 44 | 85 | Poor | 15 | Fair |
| | P | 4 | 19 | 8 | 31 | 9.9 | 54 | 37 | Fair | 8 | Excellent |
| | Q | 4 | 23 | 13 | 28 | 9.8 | 45 | 72 | Fair | 15 | Excellent |

(EXAMPLE 3)

Heat Treatment after Solution Heat Treating

Each of the aluminum alloys Nos. 2, 4 and 6 according to the examples, shown in Table 1, was dissolved and cast by the ordinary method. The resulting ingot was chamfered, and was then heated to 530° C. at a heating rate of 60° C./hr. Subsequently, the ingot was kept at this temperature for 4 hours to be homogenized. Thereafter, it was hot-rolled to a thickness of 5 mm at a temperature of 270° to 530° C., and was then cold-rolled at a rolling reduction of 80%. Thus, aluminum alloy sheets with a thickness of 1 mm were obtained.

These aluminum alloy sheets were subjected to solution heat treating under the following conditions. More specifically, they were heated at a heating rate of 400° C./min, kept a 530° C. for 20 seconds, and then rapidly cooled to 100° C. at a cooling rate of 800° C./min.

Subsequently, as shown in Table 5, the aluminum alloy sheets were left at rom temperature for 1 hour to 7 days, heated to and kept at a temperature of 40° to 170° C. for a period of 15 minutes to 48 hours, and then left at room temperature for 30 days. Thereafter, the various tests were conducted in the same manner as aforesaid. Table 6 shows the results of these tests. All the manufacturing conditions in Table 5 are within the ranges provided by the present invention. Group (I), which is provided by claim 6 of the present invention, includes examples of preferred conditions for the heat treatment.

In Group (I) according to tee present invention, the heat treatment after the solution heat treatment was performed under the preferred conditions, as shown in Table 6, or in a manner such that the aluminum alloy sheet was heated at a temperature of 60° to 150° C. for 1 to 36 hours, within 72 hours after the solution heat treatment. In this case, as seen from Table 6, the filiform corrosion resistance, formability, and postbaking strength (bake-hardenability) are improved, and in particular, the bake-hardenability and the filiform corrosion resistance are much higher than in the case of Group (II) according to the invention, which is deviated from claim 6.

TABLE 5

| | | Production Symbol | Alloy No. | Leaving time After Solution Heat Treating (hr) | Heat Treatment After Leaving At Room Temperature (°C. × hr) |
|---|---|---|---|---|---|
| Method of Invention | I | a | 2 | 1 | 100 × 12 |
| | | b | 4 | 2 | 100 × 12 |
| | | c | 4 | 24 | 100 × 12 |
| | | d | 4 | 48 | 100 × 12 |
| | | e | 4 | 24 | 70 × 30 |
| | | f | 4 | 24 | 140 × 2 |
| | | g | 6 | 2 | 100 × 12 |
| | | h | 4 | 84 | 100 × 12 |
| Comparative Method | II | i | 4 | 168 | 100 × 12 |
| | | j | 4 | 24 | 40 × 48 |
| | | k | 4 | 24 | 160 × 1 |

TABLE 5-continued

| Production Symbol | Alloy No. | Leaving time After Solution Heat Treating (hr) | Heat Treatment After Leaving At Room Temperature (°C. × hr) |
|---|---|---|---|
| 1 | 4 | 24 | 170 × 0.25 |

TABLE 6

| | Production Symbol | Alloy No. | Material Properties: Tensile Strength (kg/mm²) | Material Properties: Yield Strength (kg/mm²) | Material Properties: Elongation (%) | Material Properties: Erichsen Value (mm) | Properties of Baking Material: Post-baking Yield Strength (kg/mm²) | Properties of Baking Material: Filiform Corrosion Resistance |
|---|---|---|---|---|---|---|---|---|
| Method of Invention I | a | 2 | 21 | 12 | 32 | 10.1 | 16 | Excellent |
| | b | 4 | 22 | 12 | 33 | 10.3 | 17 | Excellent |
| | c | 4 | 23 | 13 | 32 | 10.2 | 15 | Excellent |
| | d | 4 | 23 | 13 | 32 | 10.1 | 15 | Excellent |
| | e | 4 | 23 | 13 | 32 | 10.2 | 16 | Excellent |
| | f | 4 | 24 | 14 | 31 | 10.1 | 15 | Excellent |
| | g | 6 | 23 | 13 | 30 | 9.9 | 17 | Excellent |
| Method of Invention II | h | 4 | 23 | 13 | 30 | 10.0 | 13 | Good |
| | i | 4 | 23 | 14 | 29 | 9.9 | 14 | Good |
| | j | 4 | 23 | 13 | 30 | 9.9 | 13 | Good |
| | k | 4 | 24 | 15 | 26 | 9.3 | 15 | Good |
| | l | 4 | 24 | 15 | 27 | 9.2 | 15 | Good |

(EXAMPLE 4)

From Homogenization to Heat Treatment after Solution Heat Treating

An aluminum alloy No. 3 according to the examples, which hardly contained Cu, as shown in Table 1, was dissolved and cast by the ordinary method. The resulting ingot was chamfered, heated at a heating rate of 50° C./hr to be homogenized under the conditions shown in Table 7, and hot-rolled to a thickness of 7 mm at a temperature of 250° to 580° C. Subsequently, cold rolling was started and then followed by intermediate annealing (at 350° C. for 2 hours). Thus, aluminum alloy sheets with a thickness of 1 mm were obtained with use of the various final cold-rolling reductions shown in Table 7.

After the cold rolling, these aluminum alloy sheets were subjected to solution heat treating under the conditions shown in Table 7. Subsequently, they were left at room temperature for 12 hours, heated under the conditions shown in Table 7, and then left at room temperature for 30 days. Thereafter, the various tests were conducted in the same manner as aforesaid. Table 8 shows the results of these tests.

In the case of a comparative aluminum alloy sheet in which one or some of the conditions, including the homogenization conditions for the homogenization and the cooling rate and the heating and holding conditions for the solution heat treatment, are deviated from claim 6 of the present invention, the electric conductivity and/or the crystal grain size is poor, and microcracks or lowering of the filiform corrosion resistance is caused. Even though the aluminum alloy sheet does not contain Cu, filiform corrosion is liable to be caused if the electric conductivity is too low. If the electric conductivity is too high, on the other hand, microcracks tend to be caused.

TABLE 7

| | Production Symbol | Alloy No. | Homogenizing Condition (°C. × hr) | Intermediate Annealing | Cold-rolling Reduction (%) | Solution Quenching Conditions: Heating Rate (°C./min) | Solution Quenching Conditions: Heating Hold (°C. × min) | Solution Quenching Conditions: Cooling Rate (°C./min) | Heat Treatment After Solution Heat Treating (°C. × hr) |
|---|---|---|---|---|---|---|---|---|---|
| Comparative Example | (A) | 3 | 580 × 12 | Done | 40 | 400 | 570 × 20 | 800 | Undone |
| Comparative Example | (B) | 3 | 580 × 12 | Done | 40 | 400 | 550 × 20 | 800 | Undone |
| Invention | (C) | 3 | 520 × 4 | Done | 80 | 400 | 520 × 30 | 800 | 120 × 4 |
| Invention | (D) | 3 | 480 × 4 | Done | 80 | 400 | 500 × 30 | 400 | 140 × 2 |
| Comparative Example | (E) | 3 | 440 × 4 | Done | 80 | 400 | 470 × 30 | 100 | 150 × 2 |

TABLE 8

| | Production Symbol | Alloy No. | Conductivity IACS (%) | Mean Grain Size (μm) | Micro-crack Resistance of Material | Filiform Corrosion Resistance of Baking Material |
|---|---|---|---|---|---|---|
| Comparative Example | (A) | 3 | 40 | 90 | Good | Fair |
| Comparative Example | (B) | 3 | 42 | 80 | Good | Good |
| Invention | (C) | 3 | 46 | 40 | Excellent | Excellent |
| Invention | (D) | 3 | 49 | 40 | Good | Excellent |

TABLE 8-continued

| | Production Symbol | Alloy No. | Conductivity IACS (%) | Mean Grain Size (μm) | Micro-crack Resistance of Material | Filiform Corrosion Resistance of Baking Material |
|---|---|---|---|---|---|---|
| Comparative Example | (E) | 3 | 53 | 38 | Fair | Excellent |

What is claimed is:

1. An aluminum alloy sheet having good weldability, filiform corrosion resistance, formability, and bake-hardenability, consisting essentially of 0.5 to 1.4% magnesium, 0.6 to 1.5% silicon, 0.005 to 0.1% titanium and less than 0.1% copper, all by weight, and aluminum and inevitable impurities for the remainder, the ratio of the silicon content to the magnesium content being 0.65 or more, the average crystal grain size and the electric conductivity of said aluminum alloy sheet being 70 μm or less and 43 to 51% IACS, respectively.

2. The aluminum alloy sheet according to claim 1, wherein said aluminum alloy contains at least one component selected from the group consisting of 0.1% or less manganese, 0.1% or less chromium, 0.05% or less zirconium, 0.05% or less vanadium, and 0.3% or less iron, all by weight, the sum total of said contents being 0.4% or less by weight.

3. A method for manufacturing an aluminum alloy sheet having good weldability, filiform corrosion resistance, formability, and bake-hardenability, comprising:

a homogenizing process for heating an ingot of an aluminum alloy to a temperature of 460° to 570° C. to homogenize the same, said aluminum alloy consisting essentially of 0.5 to 1.4% magnesium, 0.6 to 1.5% silicon, 0.005 to 0.1% titanium, all by weight, and aluminum and inevitable impurities for the remainder, the ratio of the silicon content to the magnesium content being 0.65 or more;

a hot rolling process for hot-rolling said homogenized ingot;

a cold rolling process for cold-rolling said hot-rolled sheet at a cold-rolling reduction of 30% or more; and a solution heat treatment for heating said cold-rolled sheet to a solution temperature of 490° to 560° C. at a heating rate of 200° C./min or more, keeping said sheet at said solution temperature for 5 to 80 seconds, and then cooling said sheet from said solution temperature to 100° C. at a cooling rate of 200° C./min or more, whereby the average crystal grain size and the electric conductivity of said sheet are adjusted to 70 μm or less and 43 to 51% IACS, respectively.

4. The method according to claim 3, further comprising a heating process for heating said sheet to a temperature of 60° to 150° C. for 1 to 36 hours, within 72 hours after the end of said solution heat treatment.

5. The method according to claim 3, wherein said aluminum alloy contains at least one component selected from the group consisting of 0.1% or less manganese, 0.1% or less chromium, 0.5% or less zirconium, 0.05% or less vanadium, and 0.3% or less iron, all by weight, the sum total of said contents being 0.4% or less by weight.

6. The method according to claim 4, wherein said aluminum alloy contains at least one component selected from the group consisting of 0.1% or less manganese, 0.1% or less chromium, 0.05% or less zirconium, 0.05 % or less vanadium, and 0.3% or less iron, all by weight, the sum total of said contents being 0.4% or less by weight.

* * * * *

UNITED STATES PATENT AND TRADEMARK OFFICE

CERTIFICATE OF CORRECTION

PATENT NO. : 4,909,861

DATED : March 20, 1990

INVENTOR(S) : Yasuo Muraoka et al

It is certified that error appears in the above-identified patent and that said Letters Patent is hereby corrected as shown below:

Column 10, line 52, Table 3, under the heading "Heating Hold", "(°C. x min)" should read --(°C. x sec)--.

Column 14, line 49, Table 7, under the heading "Heating Hold", "(°C. x min)" should read --(°C. x sec)--.

Signed and Sealed this

Twenty-seventh Day of October, 1992

*Attest:*

DOUGLAS B. COMER

*Attesting Officer*

*Acting Commissioner of Patents and Trademarks*